US008552964B2

(12) United States Patent
Kim et al.

(10) Patent No.: US 8,552,964 B2
(45) Date of Patent: Oct. 8, 2013

(54) BACKLIGHT ASSEMBLY AND METHOD OF DRIVING THE SAME

(75) Inventors: Gi-Cherl Kim, Yongin-si (KR); Moon-Hwan Chang, Cheonan-si (KR); Jeom-Oh Kim, Jeonlabuk-do (KR)

(73) Assignee: Samsung Display Co., Ltd. (KR)

( * ) Notice: Subject to any disclaimer, the term of this patent is extended or adjusted under 35 U.S.C. 154(b) by 1501 days.

(21) Appl. No.: 11/931,028

(22) Filed: Oct. 31, 2007

(65) Prior Publication Data

US 2008/0111502 A1 May 15, 2008

(30) Foreign Application Priority Data

Nov. 15, 2006 (KR) ..... 10-2006-0112958

(51) Int. Cl.
*G09G 3/36* (2006.01)
*G09G 5/10* (2006.01)
*G05F 1/00* (2006.01)

(52) U.S. Cl.
USPC ..... 345/102; 345/89; 345/98; 345/690; 315/308

(58) Field of Classification Search
USPC ..... 345/30–104
See application file for complete search history.

(56) References Cited

U.S. PATENT DOCUMENTS

| | | | | |
|---|---|---|---|---|
| 7,183,727 | B2 * | 2/2007 | Ferguson et al. | 315/308 |
| 7,372,474 | B2 * | 5/2008 | Kurita et al. | 345/690 |
| 2004/0201562 | A1 * | 10/2004 | Funamoto et al. | 345/89 |
| 2005/0248524 | A1 * | 11/2005 | Feng et al. | 345/102 |
| 2006/0139289 | A1 * | 6/2006 | Yoshida et al. | 345/98 |
| 2007/0176883 | A1 * | 8/2007 | Hsu et al. | 345/102 |

* cited by examiner

*Primary Examiner* — Charles V Hicks
(74) *Attorney, Agent, or Firm* — Cantor Colburn LLP

(57) ABSTRACT

A plurality of point-light sources emits light, based on an image displayed on a display panel. A substrate has the point-light sources disposed thereon. A power-controlling section provides the point-light sources with first driving current having a pulse current with a pulse modulation duty less than or equal to a maximum pulse modulation duty cycle and a first amplitude in accordance with a normal image. A power-controlling section provides the point-light sources with second driving current having a pulse current with the maximum pulse modulation duty cycle and first boosting amplitude greater than the first amplitude in accordance with a high luminance image. Thus, the quantity of emitted light of the point-light sources may be adjusted in accordance with the position of an image displayed in a display panel, and the point-light sources that correspond to high luminance images may be boosted up.

18 Claims, 8 Drawing Sheets

BACKLIGHT ASSEMBLY AND METHOD OF DRIVING THE SAME

CROSS-REFERENCE TO RELATED APPLICATIONS

This application claims priority to Korean Patent Application No. 2006-112958, filed on Nov. 15, 2006, and all the benefits accruing therefrom under 35 U.S.C. §119, the content of which is incorporated herein by reference in its entirety.

BACKGROUND OF THE INVENTION

1. Field of the Invention

The present invention relates to a backlight assembly and a method of driving the same.

2. Description of the Related Art

Generally, a display device such as a liquid crystal display (LCD) device comprises a backlight assembly that provides a display panel with light to display an image in a dark place. A light source used in the backlight assembly may comprise a cold cathode fluorescent lamp (CCFL) and a light-emitting diode (LED).

In general, when power is supplied to the backlight assembly, a hold-type backlight assembly that continuously emits a backlight, regardless of the image that is displayed in the display panel, has been mainly used. However, recently, in order to decrease the power consumption and increase the contrast ratio of an image, a dimming type backlight assembly that adjusts the luminance of a backlight in accordance with the luminance of an image has been developed.

Methods of dimming a backlight comprise but are not limited to zero-dimensional (0-D) dimming method, one-dimensional (1-D) dimming method, two-dimensional (2-D) dimming method, and the like. According to the 0-D dimming method, the luminance of the display image is adjusted by the total screen. According to the 1-D dimming method, the luminance of the display image is adjusted by lines. According to the 2-D dimming method (or local dimming method), the luminance of the display image is adjusted by a small area of the display image.

In case of the CCFL, the 0-D and 1-D dimming methods are adapted, but the local dimming method is not adapted. The LED has characteristics, for example, such as low power consumption, small size, light weight, and the like, in comparison with a backlight assembly such as CCFL, therefore LEDs are generally adapted in a backlight assembly for an LCD device. That is, the local dimming method may be adapted in the LED.

In case of the local dimming method, LEDs corresponding to black areas of an image are turned-off, and LEDs corresponding to the other areas emit light in correspondence with the luminance of the image so that the light-emitting quantity is adjusted.

A driving current of a direct type or a pulse-width-modulation (PWM) type may be applied to the LED. In order to enhance color reproducibility and to emit light at uniform wavelengths, the driving current of the PWM type is used in the LED.

When a local dimming method is performed through the PWM method, the current quantity that flows in the LED is adjusted by the PWM dimming signal. The luminance of the LED is determined by the total current quantity that flows to the LED by varying PWM duty cycle when amplitude of a pulse current is fixed. Thus, a light-emitting quantity may be adjusted in accordance with a position of an image displayed in a display panel.

In the predetermined area corresponding to the predetermined image, it is often required that an image with high clarity and high luminance is displayed. Thus, a high luminance backlight assembly is required in the predetermined area, which is higher than the maximum luminance that may be obtained by the PWM duty cycle.

SUMMARY OF THE INVENTION

The present invention provides a backlight assembly having a function of a local dimming to realize a high luminance image.

The present invention also provides a method of driving the backlight assembly.

In one aspect of the present invention, a backlight assembly comprises a plurality of point-light sources, a substrate and a power-controlling section. The point-light sources emit light. The substrate has the point-light sources disposed thereon. The power-controlling section provides the point-light sources with first driving current having a first pulse current with a first pulse duty and first amplitude in accordance with a normal image. The power-controlling section provides the point-light sources with a second driving current having a second pulse current with a second pulse duty and a second amplitude in accordance with a high luminance image. Here, the first pulse duty less than or substantially equal to the second pulse duty, and the first amplitude less than the second amplitude.

In an exemplary embodiment, the power-controlling section may comprise a local dimming circuit and a power-applying section. The local dimming circuit section provides a pulse-width-modulation (PWM) dimming signal that indicates a light-emitting quantity of the point-light sources based on an image signal from an external device. The power-applying section provides the point-light sources with one of the first and second driving currents based on the PWM dimming signal.

In another aspect of the present invention, a backlight assembly adjusts a light-emitting quantity of a plurality of point-light sources in accordance with the position of an image displayed in a display panel. A first driving current is provided to the point-light sources. The first driving current has a first pulse current with a first pulse duty and a first amplitude in accordance with a normal image. Then, a second driving current is provided to the point-light sources. The second driving current has second pulse current and second amplitude. Here, the first pulse duty less than or substantially equal to the second pulse duty, and the first amplitude less than the second amplitude.

In an exemplary embodiment, the second driving current may further comprise a third pulse current with third amplitude that is different from the second amplitude.

In an exemplary embodiment, each of the first and second driving currents may be controlled by a PWM dimming signal that indicates a light-emitting quantity of a plurality of point-light sources in accordance with an image signal that is provided from the power-controlling section.

In an exemplary embodiment, the second pulse duty may be about 80% to about 90% of one pulse. The second amplitude may be about 1.45 times to about 1.60 times of the first amplitude.

In an exemplary embodiment, the first and second driving currents may be simultaneously applied to the point-light sources. Alternatively, the first and second driving currents may be applied to the point-light sources at different times (i.e., sequentially).

According to the backlight assembly and a method for driving the backlight assembly, a light-emitting quantity of the point-light sources may be adjusted in accordance with the position of an image displayed on a display panel, and the point-light sources that correspond to high luminance images may be boosted up.

BRIEF DESCRIPTION OF THE DRAWINGS

The above and other features and advantages of the present invention will become readily apparent by reference to the following detailed description when considered in conjunction with the accompanying drawings wherein.

DESCRIPTION OF THE EMBODIMENTS

Figure 1:
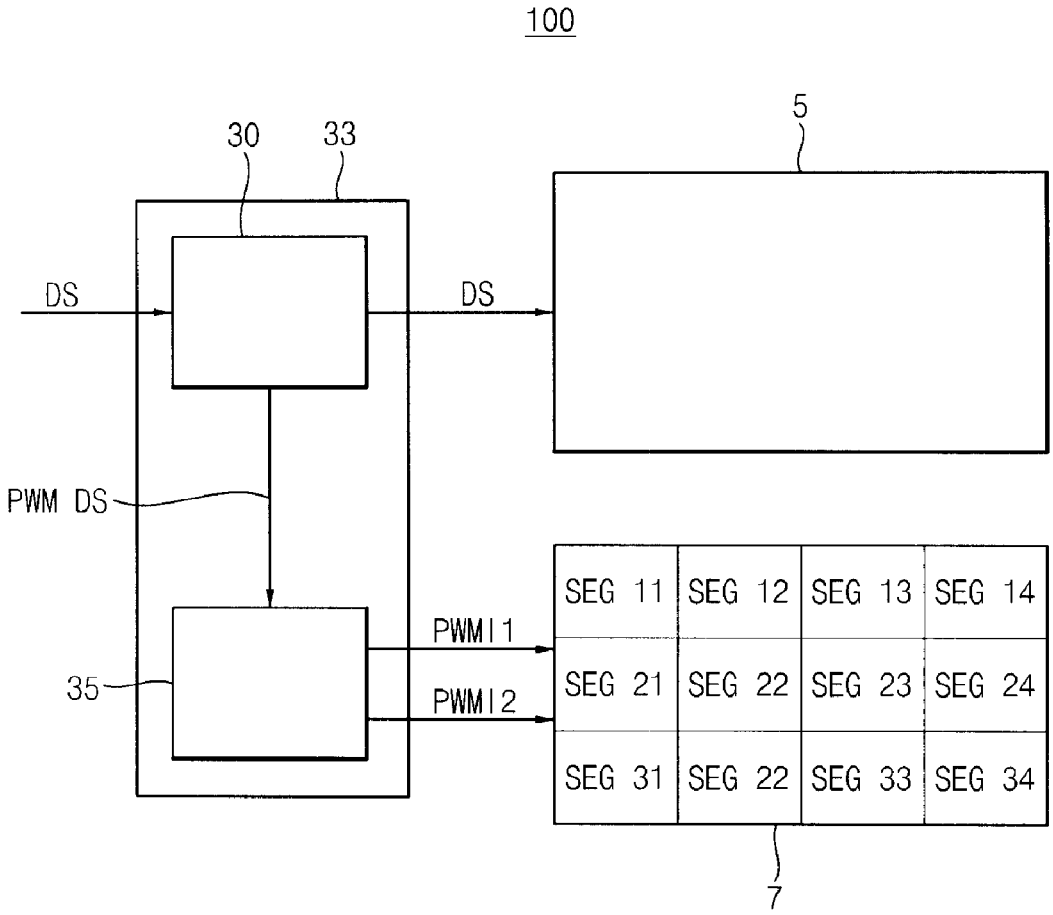
FIG. 1 is a block diagram showing a backlight assembly according to an exemplary embodiment.

The invention is described more fully hereinafter with reference to the accompanying drawings, in which embodiments of the invention are shown. This invention, however, should not be construed as limited to the embodiments set forth herein. Rather, these embodiments are provided to convey the scope of the invention to those skilled in the art. In the drawings, the size and relative sizes of layers and regions may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" comprises any and all combinations of one or more of the associated listed items.

It will be understood that, although the terms first, second, third, and the like may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, first element, component, region, layer or section discussed below could be termed second element, component, region, layer or section without departing from the teachings of the present invention.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a," "an" and "the" are intended to comprise the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-sectional illustrations that are schematic illustrations of exemplary embodiments. As such, variations from the shapes of the illustrations as a result, for example, of manufacturing techniques and/or tolerances, are to be expected. Thus, embodiments of the invention should not be construed as limited to the particular shapes of regions illustrated herein but are to comprise deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, the present invention will be described in detail with reference to the accompanying drawings.

Backlight Assembly and Method of Driving the Backlight Assembly

Figure 2:
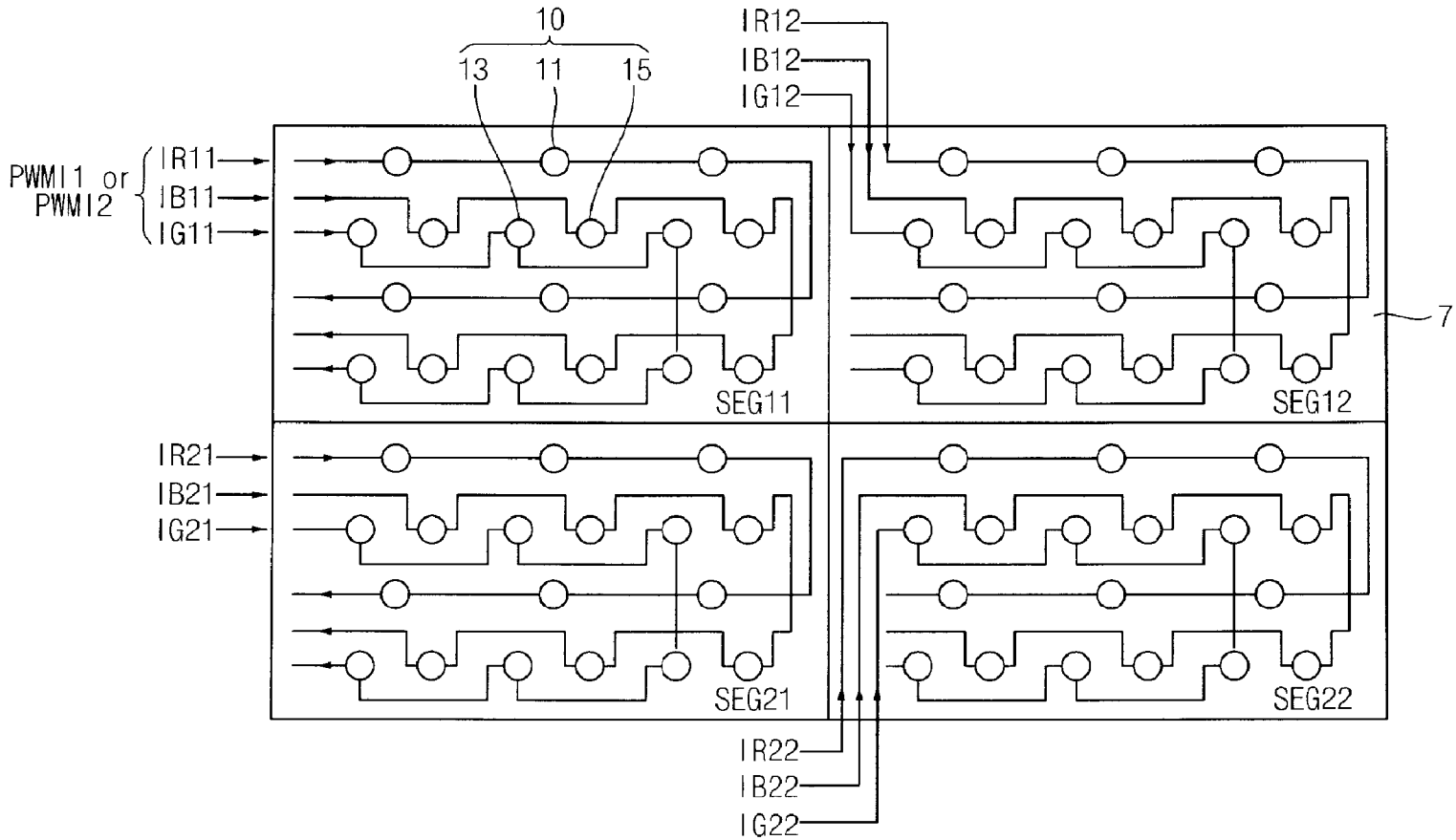
FIG. 2 is a plan view showing the substrate in FIG. 1.

FIG. 1 is a block diagram showing a backlight assembly according to an exemplary embodiment. FIG. 2 is a plan view showing the substrate in FIG. 1.

Referring to FIGS. 1 and 2, a backlight assembly 100 emits light based on an image display to a rear surface of a display panel 5. The backlight assembly 100 adjusts the quantity of emitted light corresponding to luminance in accordance with the position of an image. The backlight assembly 100 comprises a substrate 7, a plurality of point-light sources 10 and a power-controlling section 30.

The substrate 7 provides the point-light sources 10 with driving power. A plurality of point-light sources 10 is disposed on the substrate 7. In a liquid crystal display ("LCD") device, the substrate 7 may be disposed at a rear surface of the display panel 7. The substrate 7 may comprise a metal layer, an insulation layer and a power line.

The metal layer easily radiates heat generated from the point-light sources 10 toward external sides. The insulation layer is formed on the metal layer, and the power line is electrically isolated from the insulation layer. A portion of the power line is exposed to the external sides, so that the power inputting section and the ground section may be formed in the exposed portion.

Each of the point-light sources 10 may comprise a light-emitting chip. The light-emitting chip may comprise a red light-emitting chip 11 emitting a red light, a green light-emitting chip 13 emitting a green light, a blue light-emitting chip 15 emitting a blue light, and a white light-emitting chip emitting a white light. In this embodiment, each of the point-light sources 10 may comprise the red light-emitting chip 11, the green light-emitting chip 13 and the blue light-emitting chip 15.

The point-light source 10 may further comprise a power input terminal and a ground terminal. The power input terminal and the ground terminal are electrically connected to the red light-emitting chip 11, the green light-emitting chip 13 and the blue light-emitting chip 15, respectively. The power input terminal and the ground terminal may be electrically connected to the power input terminal and ground terminal of the power line that is exposed toward an external portion of the insulation layer.

The red light-emitting chip 11, the green light-emitting chip 13 and the blue light-emitting chip 15 may be packaged together in a housing that performs the function of a socket, or may be packaged individually with the housing. In this case, the power input terminal and ground terminal of the substrate 7 and the housing are electrically connected to each other, and the housing and the red, green and blue light-emitting chips 11, 13 and 15 may be electrically connected to each other. Alternatively, the power input terminal and ground terminal of the red, green and blue light-emitting chips 11, 13 and 15 are directly connected to the power input terminal and ground terminal of the substrate 7 through a soldering method, or the like.

In this exemplary embodiment, the substrate 7 comprises a plurality of light-emitting areas. The light-emitting areas are arranged in a matrix shape. A plurality of point-light sources 10 is disposed in each of the light-emitting areas. The point-light sources 10 are controlled by the light-emitting areas. As the display size of a display screen is increased, the number of light-emitting areas and point-light sources 10 may be increased. For example, when the display panel 5 is adapted in a television set, the substrate 7 corresponding to the display screen may be partitioned to no less than about thirty-two light-emitting areas.

A portion of the substrate 7 shown in FIG. 1 is illustrated in FIG. 2. That is, first light-emitting area SEG11, second light-emitting area SEG12, third light-emitting area SEG21 and fourth light-emitting area SEG22 are illustrated in FIG. 2. Six point-light sources 10 are disposed in each of the light-emitting areas SEG11, SEG12, SEG21 and SEG22 in a matrix shape of 2×3. The red, green and blue light-emitting chips 11, 13 and 15 arranged in each of the point-light sources 10 are disposed in an area that corresponds to a vertex of a triangle. In the light-emitting areas, the same color light-emitting chips are electrically connected by one power line. That is, in the light-emitting areas, the red light-emitting chips 11 are serially connected to each other, the green light-emitting chips 13 are serially connected to each other and the blue light-emitting chips 15 are serially connected to each other.

The power-controlling section 30 adjusts the light-emission quantity by the light-emitting areas in correspondence to the luminance according to the position of an image that is displayed in the display panel 5. The luminance of a normal image that is displayed in the display panel 5 is less than or equal to a maximum setting value. In case of a TV set, for example, the luminance of the maximum setting value of the normal image may be about 500 nits to about 550 nits (candelas per square meter).

However, a high luminance image (hereinafter, a predetermined image) having a luminance that is greater than the maximum-set-luminance of the normal image may be displayed in the display panel 5. The predetermined image is defined by an image that is displayed, with a luminance that is greater than the maximum-set-luminance, in a portion area of the display panel 5, and the normal image is defined by an image that is displayed in a remaining area of the display panel 5. Alternatively, the normal image may be defined by an image that is displayed, with a luminance that is smaller than or equal to the maximum-set-luminance, in the display panel 5 at the predetermined time, and the predetermined image may be defined by an image that is displayed, with a luminance that is greater than the maximum-set-luminance, in the display panel 5 at a different time than the predetermined time.

In order to enhance clarity and brightness of the predetermined image, the contrast ratio of the image may be increased. The light-emission quantity of the point-light sources 10 is increased, so that the contrast ratio of the image may be increased. In this exemplary embodiment, the point-light sources 10 are boosted so as to produce a high luminance image that is greater than the maximum-set-luminance, which are disposed on at least one of the light-emitting areas corresponding to the predetermined image.

Particularly, the power-controlling section 30 supplies first driving current to each of the light-emitting areas corresponding to the normal image. The power-controlling section 30 supplies second current to at least one of the light-emitting areas corresponding to the predetermined image.

The power-controlling section 30 supplies the first and second driving currents that are modulated by PWM method to the light-emitting areas. The power-controlling section 30 may comprise a local dimming circuit section 33 and a power-applying section 35.

The local dimming circuit section 33 receives an image signal DS from an external device. The image signal DS may comprise information regarding luminance according to a position of an image that may be displayed in the display panel 5. The local dimming circuit section 33 provides the display panel 5 with the image signal DS. The local dimming circuit section 33 outputs a PWM dimming signal PWM DS based on the image signal DS. The PWM dimming signal PWM DS indicates a light-emission quantity that may be output from each of the light-emitting areas.

The power-applying section 35 receives the PWM dimming signal (PWM DS). The power-applying section 35 pulse-width modulates a driving current that is provided from a driving power based on an indication of the PWM DS, and then outputs first driving current PWMI1 or second driving current PWMI2.

The power-applying section 35 may comprise, for example, a plurality of driving circuits, a plurality of variation current circuits, and/or the like. Each of the driving circuits may be electrically connected to power lines formed in each of light-emitting areas. Each of the driving circuits may comprise at least one transistor. The PWM dimming signal PWM DS may function as a gate signal that is applied to a gate electrode of the transistor. A source electrode of the transistor may be electrically connected to a driving power, and a drain electrode of the transistor may be electrically connected to the power line.

The PWM dimming signal PWM DS may comprise a pulse signal. Therefore, the gate electrode of the transistor is intermittently turned-on and turned-off in correspondence to the PWM dimming signal PWM DS. Thus, first driving current PWMI1 or second driving current PWMI2 may be applied to the power line as a pulse current. Alternatively, the variable current circuit may adjust amplitude of the driving voltage in correspondence to the PWM dimming signal PWM DS, or may directly adjust amplitude of the first driving current PWMI1 and amplitude of the second driving current PWMI2.

In this exemplary embodiment, the first driving current PWMI1 and the second driving current PWMI2 are supplied to the red light-emitting chip 11, the green light-emitting chip 13 and the blue light-emitting chip 15, respectively, as shown in FIG. 2. Therefore, the first driving current PWMI1 may comprise first red driving current, first green driving current and first blue driving current. The second driving current PWMI2 may comprise second red driving current, second green driving current and second blue driving current.

In FIG. 2, first red driving current IR11, IR12 and IR22, first green driving current IG11, IG12 and IG22, and first blue driving current IB11, IB12 and IB22 are, for example, applied to the first light-emitting area SEG11, the second light-emitting area SEG12 and the fourth light-emitting area SEG22. Second red driving current IR21, second green driving current IG21 and second blue driving current IB21 are applied to the third light-emitting area SEG21.

Figure 3:
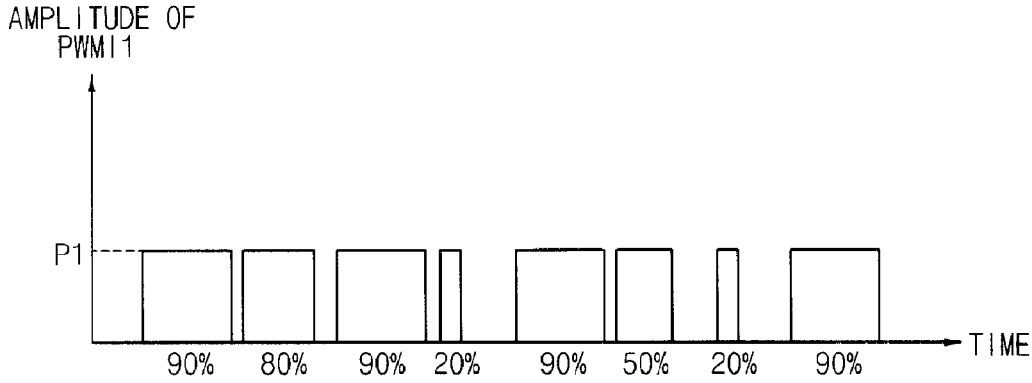
FIG. 3 is a waveform diagram showing first driving current that is applied to point-light sources.

FIG. 3 is a waveform diagram showing first driving current that is applied to point-light sources.

In a waveform diagram as shown in FIG. 3, a horizontal axis represents a time that is applied to the first driving current PWM11 and a pulse width of the pulse current. A vertical axis represents amplitude of the pulse current including the first driving current PWMI1. A plurality of percentages represents a pulse width duty cycle of the pulse current in accordance with PWM method.

The first driving current PWMI1 shown in FIG. 3 may be first red driving current IR11, IR12 and IR22, first green driving current IG11, IG12 and IG22, or first blue driving current IB11, IB12 and IB22. Pulse currents of the first driving current PWMI1 may have uniform amplitude P1, as shown in FIG. 3.

A pulse width of a pulse current of the first driving current PWMI1 may be varied in correspondence to a luminance variation according to a time of the normal image. A pulse width variation type of the first red driving current IR11, IR12 and IR22, that of the first green driving current IG11, IG12 and IG22, or that of the first blue driving current IB11, IB12 and IB22 may be the same or different. For example, the pulse width of the first driving current PWMI1 may be equal to or smaller than the maximum setting PWM duty cycle.

In case of a TV set, the maximum luminance of the normal image may be set about 500 nits to about 550 nits as described above. Here, a maximum setting PWM duty cycle of the first driving current PWMI1 may be set about 80% to about 90% of the maximum pulse modulation duty cycle.

Figure 4:
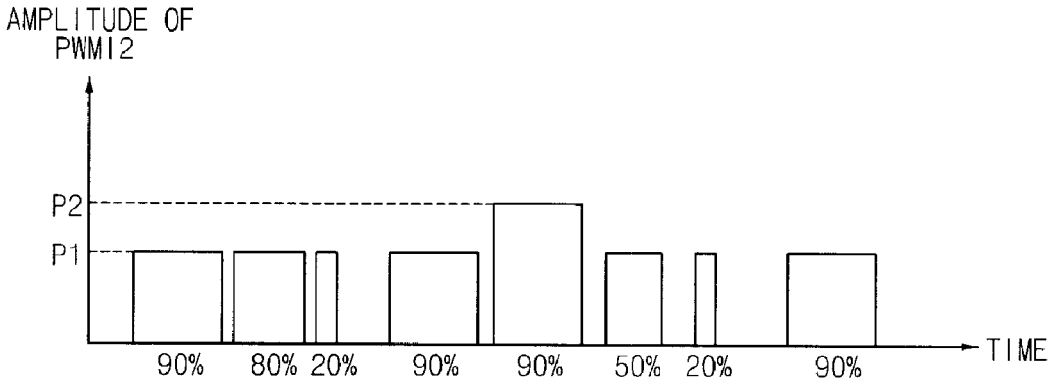
FIG. 4 is a waveform diagram showing one example of second driving current that is applied to point-light sources.
Figure 5:
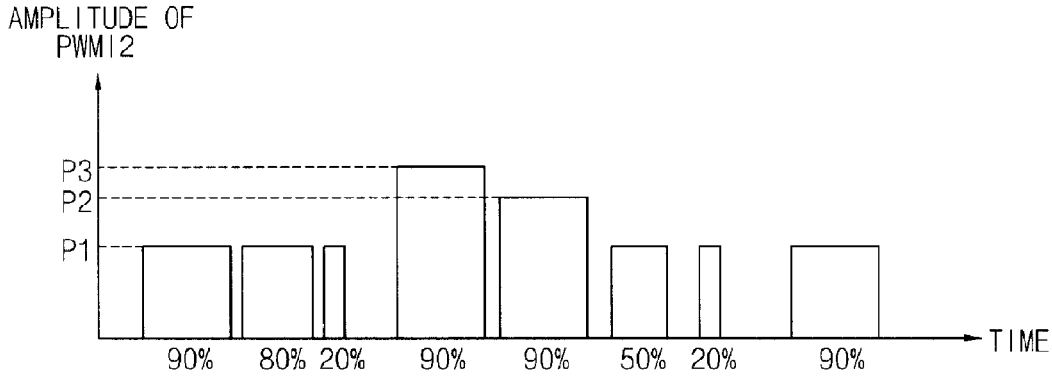
FIG. 5 is a waveform diagram showing another example of second driving current that is applied to point-light sources.

FIG. 4 is a waveform diagram showing one example of second driving current that is applied to point-light sources. FIG. 5 is a waveform diagram showing another example of second driving current that is applied to point-light sources.

Referring to FIG. 4, the predetermined image may be displayed in the display panel 5 at a predetermined time.

Luminance of the predetermined image may be much greater than 500 nits to 500 nits, which is the maximum-set-luminance of the normal image. The power-controlling section 30 applies the second driving current PWMI2 to the point-light sources 10 of at least one of the light-emitting area that corresponds to the predetermined image The second driving current PWMI2 as shown in FIG. 4 may be the second red driving current IR21, the second green driving current IG21 or the second blue driving current IB21. The second driving current PWMI2 may comprise, as shown in FIG. 4, a pulse current (hereinafter, a boosting pulse current) having a boosting amplitude P2 that is greater than an amplitude of the first driving current PWM11.

The pulse width of the boosting pulse current is set at about 80% to about 90%, which is similar to the maximum setting PWM duty cycle. Therefore, when the boosting pulse current is applied to the point-light-emitting source 10, a current quantity that is applied to the point-light source 10 is increased. Therefore, a light-emitting quantity emitted from the light-emitting area corresponding to the predetermined image may increase to about 800 nits. As a result, the predetermined image having high clarity and high brightness may be displayed in a display screen.

The first driving current PWM11 may be applied to the point-light sources 10 as shown in FIG. 4, during intervals that the boosting pulse current is not applied to the point-light sources 10.

Referring to FIG. 5, a plurality of boosting amplitudes may be in the second driving current PWMI2. That is, the second driving current PWMI2 may comprise a pulse current with a boosting amplitude P2 and a pulse current with a boosting amplitude P3 that is greater than the boosting amplitude P2. Therefore, the boosting amplitude is varied, so that boosting of the point-light sources 10 may be adjusted in accordance with the luminance of an image displayed in the predetermined area.

The backlight assembly 100 emits a white light that is generated by mixing a red light, a green light and a blue light. For example, the red, green and blue lights may be mixed in a predetermined ratio, for example, 3:6:1, with respect to a light quantity, so that the white light may be generated.

In the case of boosting the point-light sources 10 of the predetermined light-emitting area, the boosted emitted light may be a white light. The duty cycles of each of the second red, green and blue driving current IR21, IG21 and IB21 are substantially equal to each other. For example, the duty cycles of each of the second red, green and blue driving currents IR21, IG21 and IB21 may be about 80% to about 90%. Therefore, when the boosting amplitude P2 of the second red, green and blue driving currents IR21, IG21 and IB21 are adjusted differently, red, green and blue lights of a proper ratio that generates white light may be obtained.

Figure 6:
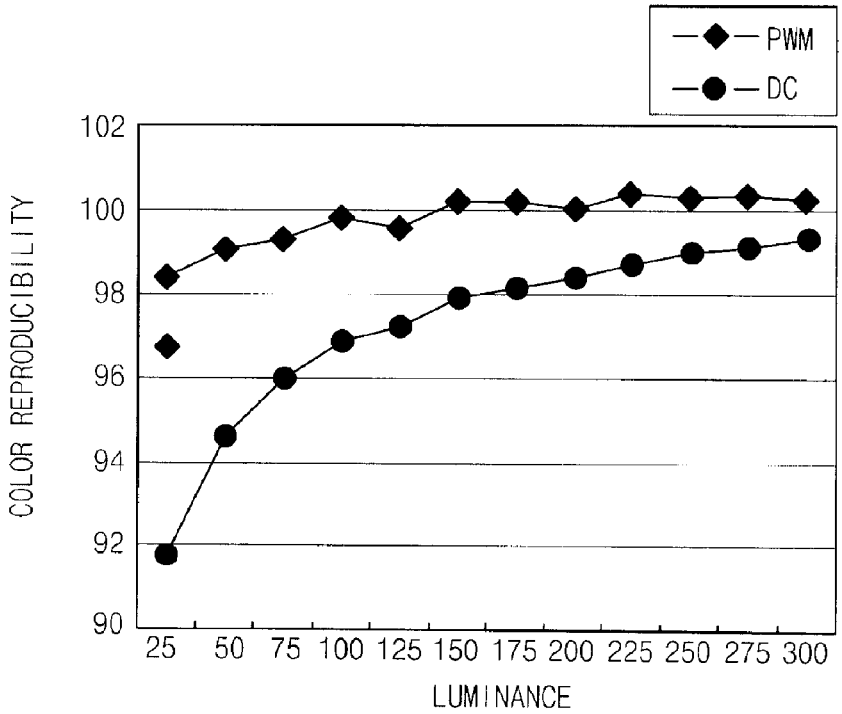
FIG. 6 is a graph showing variation of a color reproduction that corresponds to a luminance variation of the light emission of a point-light source.

FIG. 6 is a graph showing variation of a color reproduction that corresponds to a luminance variation of a light-emission of a point-light source.

In FIG. 6, a horizontal axis represents luminance of light emitted from the point-light sources 10, and a vertical axis represents color reproducibility. Two graphs showing a variation of color reproducibility for a luminance according to a driving type of the light-emitting sources 10 are shown in FIG. 2.

Referring to FIG. 6, when the point-light sources 10 are driven by a direct current (DC) method, it can be noted that the color reproducibility is low.

However, when the point-light sources 10 are driven by PWM method, it is to be noted that the color reproducibility is realized to about 98% in a low current driving. Therefore, it can be noted that driving the point-light sources 10 using PWM method is advantageous.

Moreover, when the point-light sources 10 are driven by PWM method, it is recognized that the color reproducibility is realized to about 100% in a high luminance area. Thus, a luminance of the point-light sources 10 is increased by increasing amplitude of the pulse current, so that the point-light sources 10 may be boosted-up.

Figure 7:
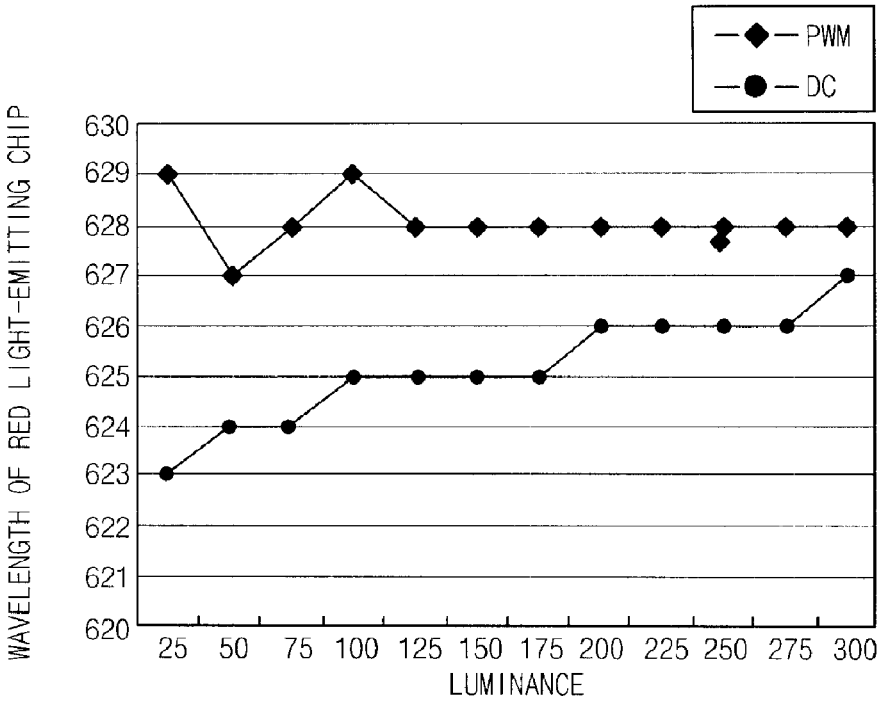
FIG. 7 is a graph showing wavelength variation of light emission of a red light-emitting chip in accordance with a driving type.
Figure 8:
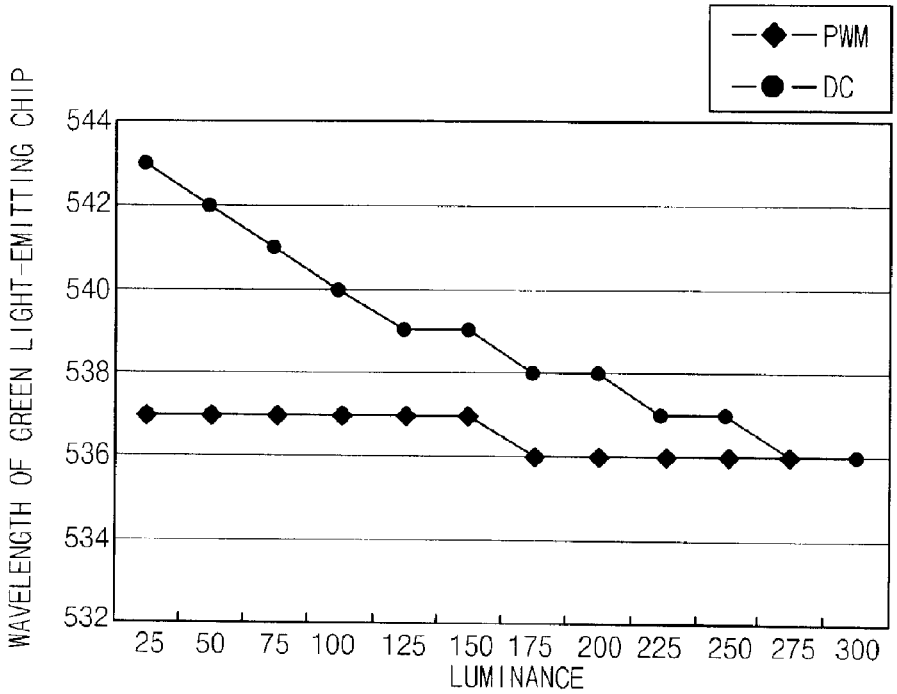
FIG. 8 is a graph showing wavelength variation of light emission of a green light-emitting chip in accordance with a driving type.
Figure 9:
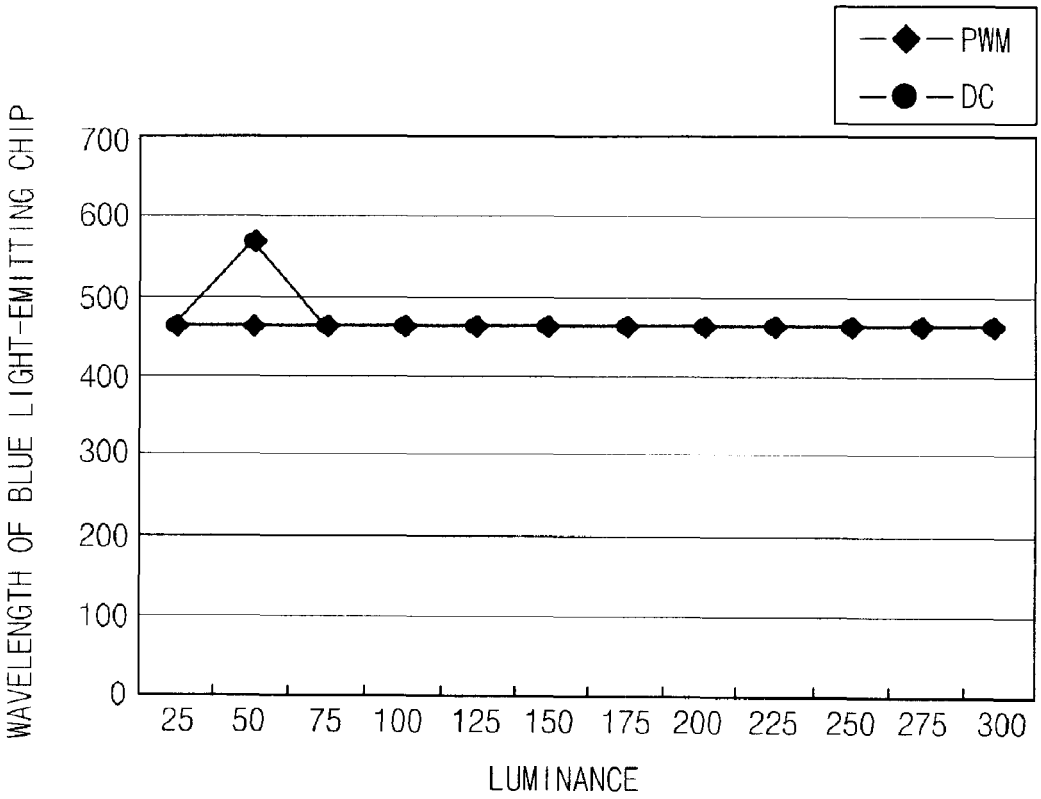
FIG. 9 is a graph showing wavelength variation of light emission of a blue light-emitting chip in accordance with a driving type.

FIG. 7 is a graph showing wavelength variation of light-emission of a red light-emitting chip in accordance with a driving type. FIG. 8 is a graph showing wavelength variation of light-emission of a green light-emitting chip in accordance with a driving type. FIG. 9 is a graph showing wavelength variation of light-emission of a blue light-emitting chip in accordance with a driving type.

In FIGS. 7, 8 and 9, a horizontal axis represents luminance of lights emitted from each of the light-emitting chips, and a vertical axis represents wavelength of the light emitted from each of the light-emitting chips.

In order to stably and efficiently obtain a white light, the wavelength of the light emitted from each of the light-emitting chips may be uniform despite a luminance variation. Referring to FIGS. 7, 8 and 9, it can be noted that the wavelength of the emitted light is uniform not only in the PWM driving method but also in the DC driving method.

Accordingly, even though the luminance of the emitted light is increased by increasing the amplitude of the pulse current, it is recognized that the wavelength of the emitted light is uniform. Thus, the amplitude of the pulse current may be freely varied.

Figure 10:
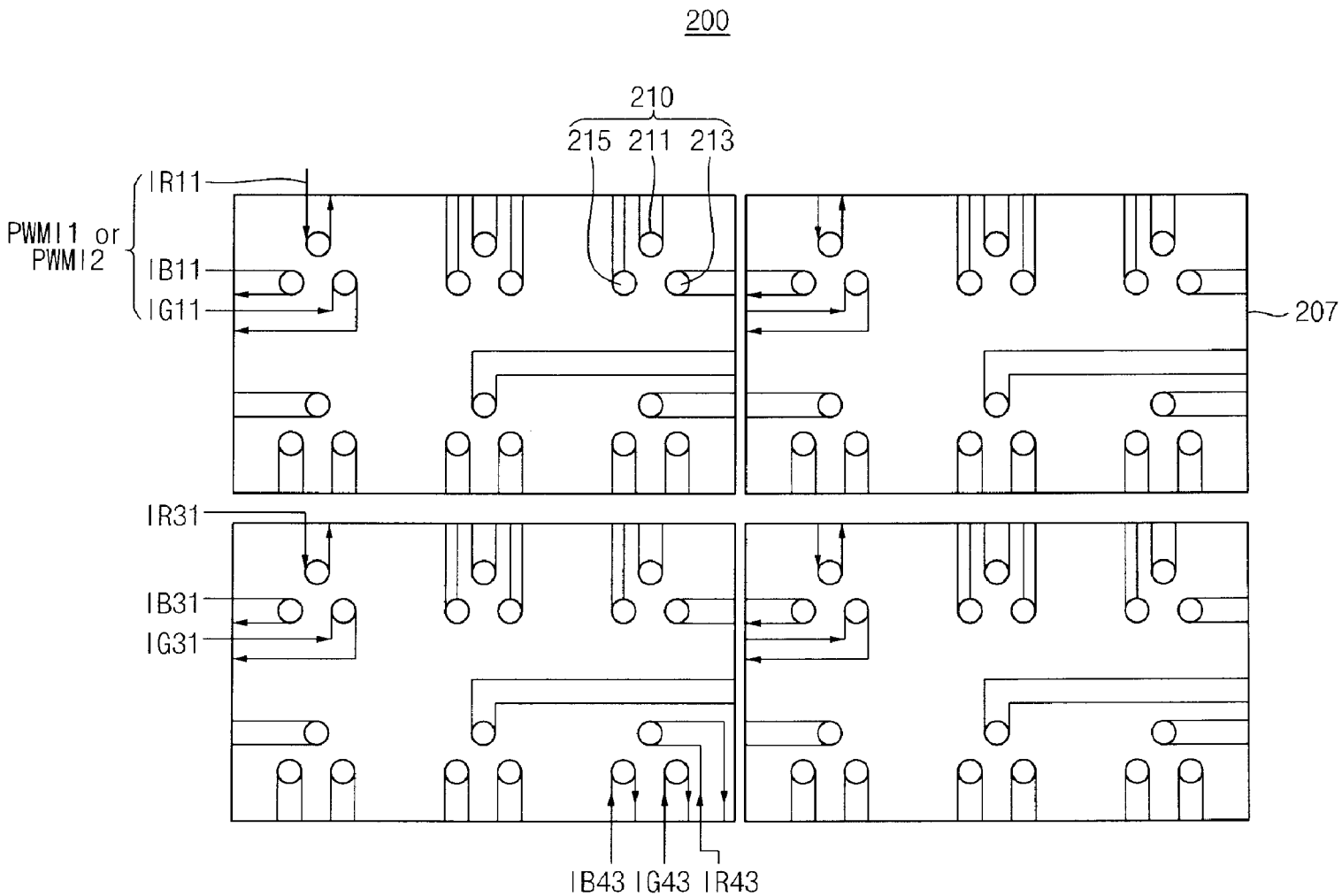
FIG. 10 is a plan view showing a backlight assembly according to one exemplary embodiment.

FIG. 10 is a plan view showing a backlight assembly according to one exemplary embodiment.

Referring to FIG. 10, a backlight assembly 200 comprises a substrate 207, a plurality of point-light sources 210 and a power-controlling section (not shown). The backlight assembly 200 is similar to the backlight assembly 100 shown in FIGS. 1 and 2 with the exception that the point-light sources 210 are individually driven. Thus, the same reference numerals will be used to refer to the parts corresponding to those described in FIGS. 1 and 2 and any further explanation concerning the above elements will be omitted.

Each of the point-light sources 210 is driven individually. That is, the first and second driving currents are individually applied to each of the point-light sources 210, respectively. The point-light sources 210 are arranged on the substrate 207 in a matrix shape. The number of point-light sources 210 and the distance interval between the point-light sources may be varied in correspondence to the size of the display screen.

In FIG. 10, the point-light sources 210 are, for example, arranged in a matrix shape of 4×6. Each of the point-light sources 210 comprises a red light-emitting chip 211, a green light-emitting chip 213 and a blue light-emitting chip 215, respectively. The red, green and blue light-emitting chips 211, 213 and 215 are arranged in a position that corresponds to three vertices of a triangle, respectively.

In this embodiment, the red, green and blue light-emitting chips 211, 213 and 215 are driven individually. Thus, different power input sections and different ground sections are electrically connected to the red, green and blue light-emitting chips 211, 213 and 215, respectively.

The power-controlling section adjusts a quantity of light emitted by the point-light sources 210 in accordance with the position of an image displayed in a display panel. That is, the power-controlling section applies first driving current or second driving current by each of the point-light sources 210 to the point-light sources 210 in accordance with a PWM dimming signal.

The first driving current may comprise first red driving current, first green driving current and first driving current. Each pulse currents of the first red, green and blue driving currents has the same amplitude. Each PWM duty cycle of the pulse currents of the first red, green and blue driving currents may be different from each other.

The second driving current has a boosting amplitude that is greater than that of the first driving current and a maximum setting PWM duty cycle. The second driving current may comprise a second red driving current, second green driving current and second blue driving current. Each of the PWM duty cycles corresponding to the second red, green and blue driving currents is equal to the maximum setting PWM duty cycle. However, each of the boosting amplitudes corresponding to the second red, green and blue driving currents may be different from each other.

When the first driving current is applied to the point-light sources 210, the point-light sources 210 emit light having a luminance that is adaptive to a normal image. The second driving current is applied to at least one of the point-light sources 210 in correspondence to the predetermined image. Therefore, at least one of the point-light sources is boosted-up, so that the boosted point-light source emits light having a luminance that is greater than the maximum-set-luminance of the normal image. As a result, the predetermined image may be realized.

Figure 11:
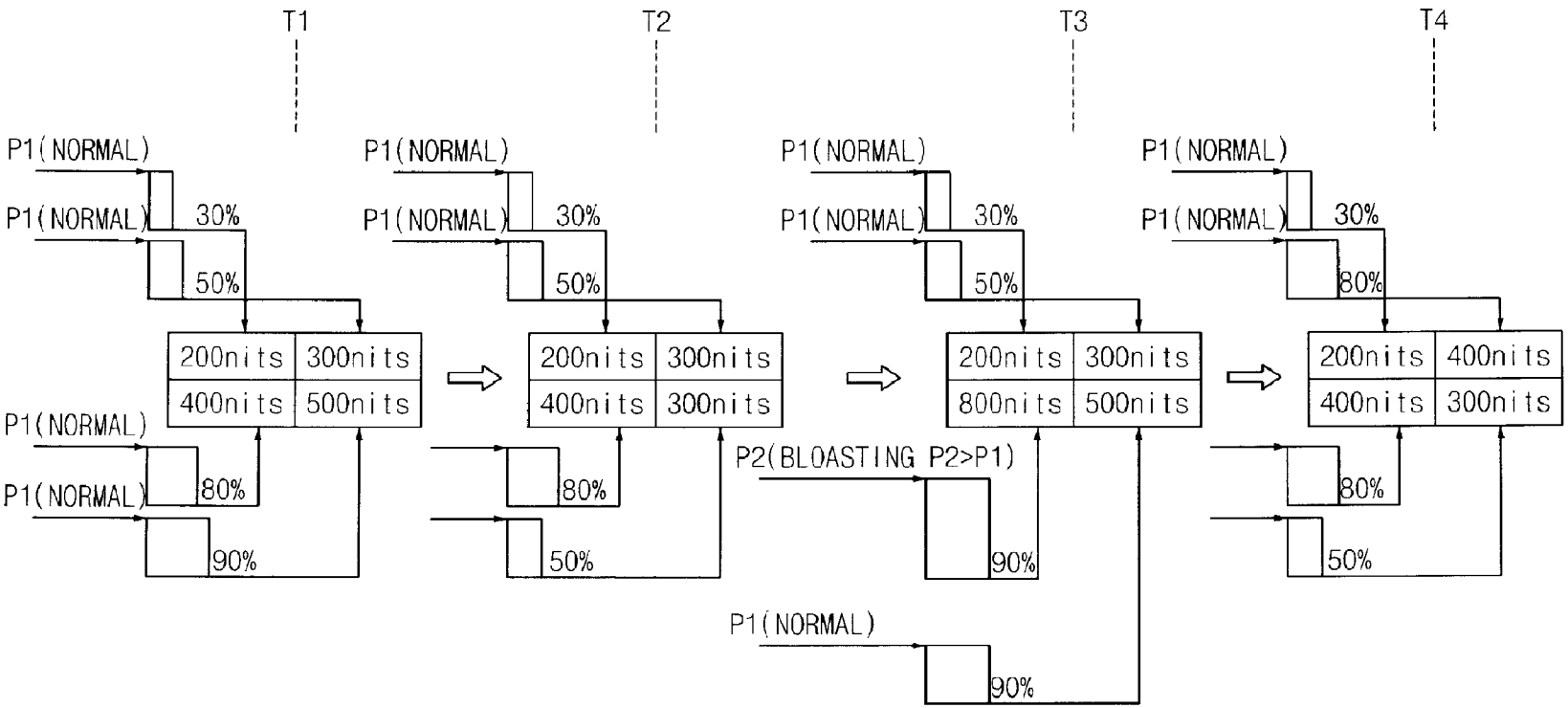
FIG. 11 is a conceptual diagram showing a method of driving a backlight assembly according to an exemplary embodiment.

FIG. 11 is a conceptual diagram showing a method of driving a backlight assembly according to an exemplary embodiment.

In FIG. 11, four light-emitting areas are illustrated, and the variation of a light-emission from each of the light-emitting areas with time is shown. For convenience of illustration, it is assumed that each of the four light-emitting areas is the same as the first light-emitting area SEG11, the second light-emitting area SEG12, the third light-emitting area SEG21 and the fourth light-emitting area SEG22, respectively, as shown in FIG. 2.

Referring to FIG. 11, a power-controlling section applies a first driving current to the first light-emitting area SEG11, the second light-emitting area SEG12, the third light-emitting area SEG21 and the fourth light-emitting area SEG22 at first time T1. That is, the pulse current is applied to the first, second, third and fourth light-emitting areas SEG11, SEG12, SEG21 and SEG22, respectively, which has uniform first amplitude P1 and a PWM duty cycle that is greater than the maximum setting PWM duty cycle.

A pulse current with a PWM duty cycle of about 30% is applied to the first light-emitting area SEG11, a pulse current with a PWM duty cycle of about 50% is applied to the second light-emitting area SEG12, a pulse current with a PWM duty cycle of about 80% is applied to the third light-emitting area SEG21, and a pulse current with a PWM duty cycle of about 90% is applied to the fourth light-emitting area SEG22. Thus, light of about 200 nits is emitted from the first light-emitting area SEG11, light of about 300 nits is emitted from the second light-emitting area SEG12, light of about 400 nits is emitted from the third light-emitting area SEG21, and light of about 500 nits is emitted from the fourth light-emitting area SEG22. Here, the first driving current with the maximum setting PWM duty cycle, that is, a pulse width of about 90% of the maximum pulse modulation duty cycle is applied to the fourth light-emitting area SEG22. Therefore, the normal image corresponding to the fourth light-emitting area SEG22 has the maximum set luminance at the first time T1.

Then, the power-controlling section applies the first driving current to the first light-emitting area SEG11, the second light-emitting area SEG12, the third light-emitting area SEG21 and the fourth light-emitting area SEG22 at the second time T2. For example, a pulse current with a PWM duty cycle of about 30% is applied to the first light-emitting area SEG11, a pulse current with a PWM duty cycle of about 50% is applied to the second light-emitting area SEG12, a pulse current with a PWM duty cycle of about 80% is applied to the third light-emitting area SEG21, and a pulse current with a PWM duty cycle of about 50% is applied to the fourth light-emitting area SEG22. Thus, light of about 200 nits is emitted from the first light-emitting area SEG11, light of about 300 nits is emitted from the second light-emitting area SEG12, light of about 400 nits is emitted from the third light-emitting area SEG21, and light of about 300 nits is emitted from the fourth light-emitting area SEG22.

Then, the power-controlling section applies the first driving current to the first light-emitting area SEG11, the second light-emitting area SEG12 and the fourth light-emitting area SEG22, and applies second driving current to the third light-emitting area SEG21 at the third time T3. For example, a pulse current with a PWM duty cycle of about 30% is applied to the first light-emitting area SEG11, a pulse current with a PWM duty cycle of about 50% is applied to the second light-emitting area SEG12, a pulse current with a PWM duty cycle of about 90% is applied to the fourth light-emitting area SEG22. A pulse current with a PWM duty cycle of about 90% is applied to the third light-emitting area SEG21.

Thus, light of about 200 nits is emitted from the first light-emitting area SEG11, light of about 300 nits is emitted from the second light-emitting area SEG12, and light of about 500 nits is emitted from the fourth light-emitting area SEG22. Light of about 800 nits is boosted-up to be emitted from the third light-emitting area SEG21. Therefore, the predetermined image corresponding to the third light-emitting area SEG21 may be displayed with a high clearness and a high brightness.

Then, the power-controlling section again applies the first driving current to the first light-emitting area SEG11, the second light-emitting area SEG12, the third light-emitting area SEG21 and the fourth light-emitting area SEG22 at the fourth time T4 to realize the normal image.

As described above, the point-light sources may be boosted-up by varying amplitude of the pulse current, so that an image may be boosted-up with higher than the maximum luminance of the normal image.

As described above, a backlight assembly adjusts a light-emitting quantity in accordance with the position of an image displayed in a display panel. Therefore, the power consumption of the backlight assembly may be reduced, and the contrast ratio of the image may be increased so that the display quality may be enhanced.

Moreover, a driving current of PWM method is applied to the point-light source, and a boosting pulse current that increases amplitude of the current is applied to the point-light source. Therefore, a high luminance image may be realized, which is difficult to be realized by varying the PWM duty cycle.

Although exemplary embodiments have been described herein, it is understood that the present invention should not be limited to these exemplary embodiments, but various changes and modifications can be made by one of ordinary skilled in the art within the spirit and scope of the present invention as claimed hereinafter.

What is claimed is:

1. A backlight assembly comprising:

a plurality of point-light sources;

a substrate having comprising the plurality of point-light sources disposed thereon; and a power-controlling section providing the plurality of point light sources representing normal images with a first driving current having a first pulse current having first pulse duty cycles with first amplitudes, and providing the plurality of point-light sources representing a high luminance image with a second driving current having a second pulse current with a second pulse duty and a second amplitude, wherein the first pulse duty cycles are different from each other, and the first amplitudes are constant, so that the first pulse duty cycles represent the normal images different from each other, and the second pulse duty cycle is larger than or substantially equal to the first pulse duty cycles, and the second amplitude is larger than the first amplitudes, so that the second amplitude represents the high luminance image different from the normal images.

2. The backlight assembly of claim 1, wherein the power-controlling section comprises:

a local dimming circuit section outputting a pulse-width-modulation (PWM) dimming signal that indicates an emitted light quantity of the point-light sources based on an image signal from an external device; and a power-applying section providing the plurality of point-light sources with one of the first and second driving currents based on the PWM dimming signal.

3. The backlight assembly of claim 1, wherein the plurality of point-light sources are grouped into a plurality of light-emitting areas arranged in a matrix shape, and the power-controlling section provides each of the plurality of light-emitting areas with at least one of the first driving current and the second driving current.

4. The backlight assembly of claim 1, wherein the power-controlling section provides each of the plurality of point-light sources with at least one of the first driving current and the second driving current.

5. The backlight assembly of claim 1, wherein the second driving current further comprises a third pulse current with a third amplitude that is different from the second amplitude.

6. The backlight assembly of claim 1, wherein each of the first and second driving currents is controlled by a pulse-width-modulation (PWM) dimming signal that indicates an emitted light quantity of the plurality of point-light sources in accordance with an image signal that is provided from the power-controlling section.

7. The backlight assembly of claim 1, wherein each of the plurality of point-light sources comprises:

a red light-emitting chip that emits a red light;

a green light-emitting chip that emits a green light; and a blue light-emitting chip that emits a blue light.

8. The backlight assembly of claim 7, wherein the second driving current comprises:

a red driving current applied to the red light-emitting chip;

a green driving current applied to the green light-emitting chip; and a blue driving current applied to the blue light-emitting chip.

9. The backlight assembly of claim 8, wherein each of the red driving current, the green driving current and the blue driving current has boosting amplitudes that are different from one another.

10. The backlight assembly of claim 9, wherein the power-controlling section adjusts the boosting amplitudes to form a white light mixture by the red light, the green light and the blue light.

11. The backlight assembly of claim 1, wherein each of the plurality of point-light sources comprises a white light-emitting chip that emits a white light.

12. A method of driving a backlight assembly, the method comprising:

providing plurality of point-light sources representing normal images with first driving currents having first pulse currents with first pulse duty cycles and first amplitudes: and providing the point-light sources representing a high luminance image with a second driving current having a second pulse current and a second amplitude, wherein the first pulse duty cycles are different from each other and the first amplitudes are constant, so that the first pulse duty cycles represent the normal images different from each other, and the second pulse duty cycle is larger than or substantially equal to the first pulse duty cycles, and the second amplitude is larger than the first amplitudes, so that the second amplitude represents the high luminance image different from the normal images.

13. The method of claim 12, wherein the second driving current further comprises a third pulse current with a third amplitude that is different from the second amplitude.

14. The method of claim 12, wherein each of the first and second driving currents is controlled by a pulse-width-modulation (PWM) dimming signal that indicates a quantity of emitted light of the plurality of point-light sources in accordance with an image signal that is provided from the power-controlling section.

15. The method of claim 12, wherein the second pulse duty is about 80% to about 90% of one pulse.

16. The method of claim 15, wherein the second amplitude is about 1.45 times to about 1.60 times greater than that of the first amplitude.

17. The method of claim 12, wherein the first and second driving currents are simultaneously applied to the point-light sources.

18. The method of claim 12, wherein the first and second driving currents are applied to the point-light sources in different times.

* * * * *